US009637971B1

(12) United States Patent
Keatts

(10) Patent No.: US 9,637,971 B1
(45) Date of Patent: May 2, 2017

(54) SCREENLET

(71) Applicant: Bradford Keatts, Moorpark, CA (US)

(72) Inventor: Bradford Keatts, Moorpark, CA (US)

( * ) Notice: Subject to any disclaimer, the term of this patent is extended or adjusted under 35 U.S.C. 154(b) by 0 days.

(21) Appl. No.: 15/244,514

(22) Filed: Aug. 23, 2016

(51) Int. Cl.

| | |
|---|---|
| ***E06B 7/32*** | (2006.01) |
| ***E06B 9/52*** | (2006.01) |
| ***E06B 11/00*** | (2006.01) |
| *E06B 9/01* | (2006.01) |

(52) U.S. Cl.
CPC ..... *E06B 9/52* (2013.01); *E06B 11/00* (2013.01); *E06B 7/32* (2013.01); *E06B 2009/015* (2013.01); *E06B 2009/524* (2013.01); *E06B 2009/527* (2013.01)

(58) Field of Classification Search
CPC ..... E06B 7/32; E06B 2009/525
USPC ..... 160/180, DIG. 16
See application file for complete search history.

(56) References Cited

U.S. PATENT DOCUMENTS

| | | | | | |
|---|---|---|---|---|---|
| 300,776 | A * | 6/1884 | Henry | E06B 9/52 | 160/180 |
| 328,064 | A * | 10/1885 | Ramser | E06B 7/32 | 114/174 |
| 1,643,939 | A * | 10/1927 | Becker | B60J 1/08 | 160/180 |
| 1,684,027 | A * | 9/1928 | Hinman | B60J 1/2011 | 160/116 |
| 1,744,177 | A * | 1/1930 | Schuler | B60J 1/2011 | 160/180 |
| 1,780,823 | A * | 11/1930 | Johnson | E06B 9/52 | 160/103 |
| 4,031,942 | A * | 6/1977 | Shelton | B60J 1/2011 | 160/103 |
| 4,334,573 | A * | 6/1982 | Hackman | E06B 7/32 | 160/180 |
| 4,603,724 | A * | 8/1986 | Borwick | E06B 9/52 | 160/180 |
| 4,642,257 | A * | 2/1987 | Chase | G09F 7/04 | 156/94 |
| 5,117,890 | A * | 6/1992 | Taylor | E06B 7/32 | 160/180 |
| 5,535,804 | A * | 7/1996 | Guest | E06B 7/32 | 160/180 |
| 6,634,407 | B1 * | 10/2003 | Strohmeyer | E06B 9/24 | 160/116 |
| 7,913,741 | B1 * | 3/2011 | Aulet | E06B 9/52 | 160/180 |
| 8,495,835 | B2 * | 7/2013 | Timmons | E06B 7/32 | 160/180 |
| 8,881,788 | B1 * | 11/2014 | Spencer | E06B 9/52 | 160/180 |

(Continued)

*Primary Examiner* — David Purol
(74) *Attorney, Agent, or Firm* — William J. Benman; Benman, Brown & Williams

(57) ABSTRACT

A screenlet comprising a frame; a flexible flap secured on one edge thereof to the frame; and an arrangement for securing the frame over an aperture in a screen or window. In a specific embodiment, the flap is made of a flexible material (e.g. rubber) designed to cover the aperture when the screenlet is in use. The aperture allows for a power cord or hose to be passed through the screen when the screenlet is in an open position and for the screen to be secured against insects and other pests when the screenlet is in use or closed. Several arrangements are disclosed for securing the flap to the frame including fastener, hook and loop, magnetic and adhesive embodiments.

12 Claims, 5 Drawing Sheets

(56) References Cited

U.S. PATENT DOCUMENTS

2008/0134584 A1* 6/2008 McGhee ..... E06B 7/32
49/484.1

* cited by examiner

SCREENLET

BACKGROUND OF THE INVENTION

Field of the Invention

The present invention relates to physical structures. Specifically, the present invention relates to apparatus and methods for providing access through apertures in houses and other building structures.

Description of the Related Art

Unfortunately, for many home owners, most homes have too few external outlets. Hence, a need exists in the art for an apparatus or method for providing electrical power to lights, machines and other devices located outdoors near one's home for events and other outdoor activities. Traditionally, this problem has been addressed by opening a door or window and running one or more extension cords from an interior outlet to an outdoor device or machine. This is typically achieved by leaving the window or door partially open to enable the cord to be passed therethrough. Unfortunately, as is well-known in the art, leaving a window or door partially open enables mosquitoes, flies and other insects to enter the premises and bite or pester the occupants thereof.

Hence, a need exists in the art for an improved system or method for passing utility cords through structure apertures while simultaneously providing ingress by pests to the associated premises.

SUMMARY OF THE INVENTION

The need in the art is addressed by the apparatus called a 'screenlet' of the present invention. In an illustrative embodiment, the inventive screenlet comprises a frame; a flexible or rigid flap or door secured on one edge thereof to the frame; and an arrangement for securing the frame over an aperture in a screen or window.

In a specific embodiment, the flap is made of a flexible material (e.g. rubber) or a non-flexible material (e.g. plastic) designed to cover the aperture when the screenlet is not in use. The aperture allows for a cord, wiring or hose to be passed through the screen when the screenlet is in an open position and for the screen to be secured against insects and other pests when the screenlet is closed. Several arrangements are disclosed for securing the flap to the frame including fastener, hook and loop, magnetic and adhesive embodiments as well as simple nuts, bolts and/or screws.

The invention provides a new approach to screens and windows and enables a new design for same.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
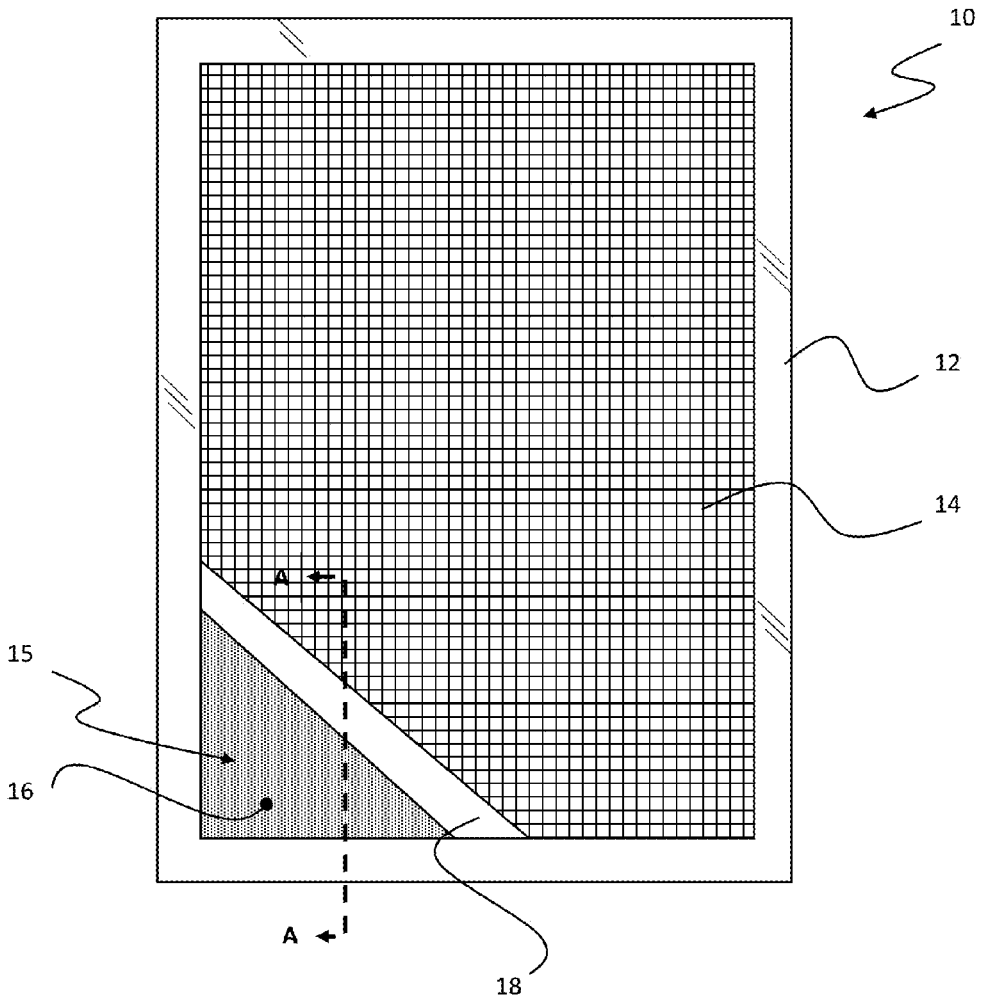
FIG. 1 is a front view of a screen with an illustrative embodiment of a screenlet of the present invention in a first (closed) position thereof.

FIG. 1 is a front view of a screen with an illustrative embodiment of a screenlet of the present invention in a first (closed) position thereof.

As shown in FIG. 1, the screen 10 is of conventional design and construction, to the extent that it includes a frame 12 and a screen 14. However, in accordance with the present teachings, the screen further includes a screenlet 15. The screenlet 15 includes a flap and/or door 16 made of flexible material such as rubber or non-flexible plastic. In the best mode, the flap 16 is a triangle of approximate length 12.5 cm along an x-axis and approximately 12.5 cm along a y-axis and 18 cm for the diagonal spine. In the best mode, the flap has a depth range of $1/16^{th}$ to $1/8^{th}$ inches or 0.15875 to 0.3175 cm. However, those of ordinary skill in the art will appreciate that the present teachings are not limited to the dimensions set forth herein with respect to the illustrative embodiment. That is, one of ordinary skill in the art will appreciate that the dimensions of the flap will vary based on the application.

In the embodiment of FIG. 1, the flap 16 is secured to the screen 10 via a two-piece screenlet frame having a front portion 18 shown in FIG. 1 and a mating rear portion 18' shown in FIG. 3 as discussed more fully below. The screenlet frame 18, 18' may be constructed of plastic, wood, metal or other suitably rigid material.

Figure 2:
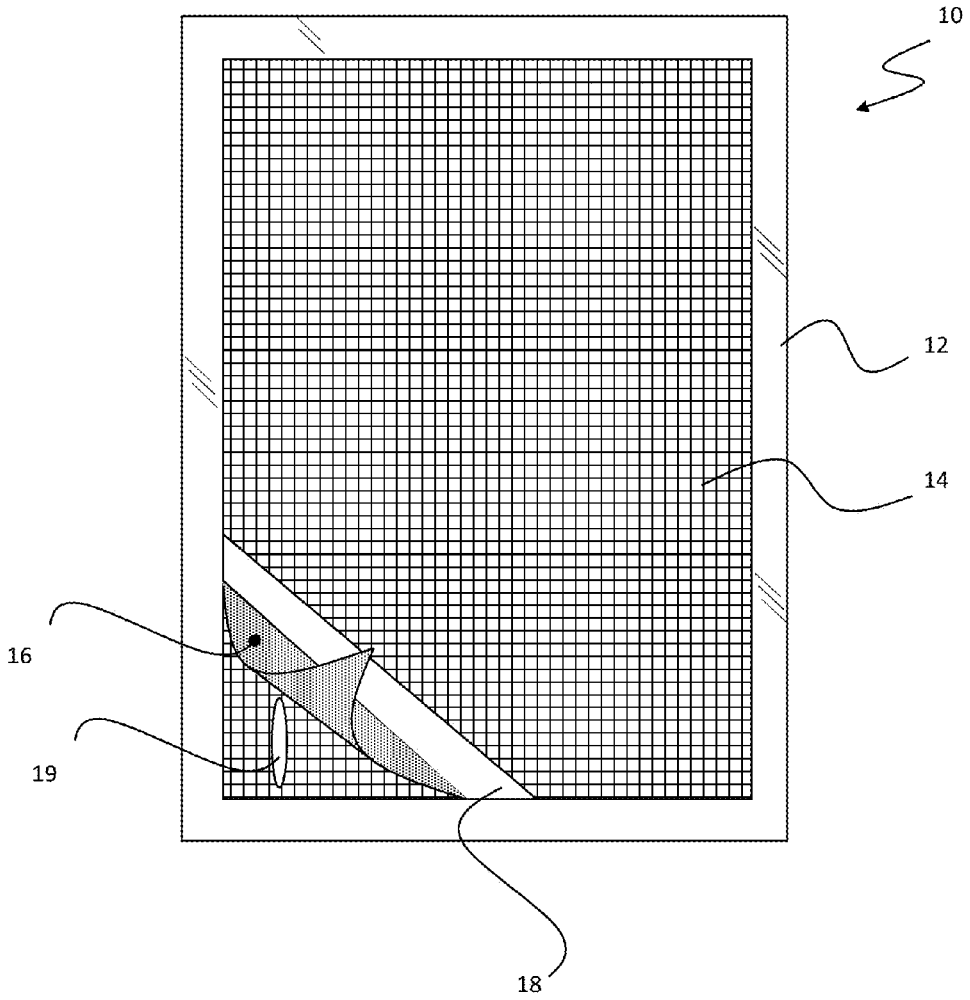
FIG. 2 is a front view of the screen of FIG. 1 with the screenlet of the present invention in a second (open) position thereof.

The screenlet allows for the selective opening and closure of an aperture 19 in the screen 14 as shown in FIG. 2.

FIG. 2 is a front view of the screen of FIG. 1 with the screenlet of the present invention in a second (open) position thereof.

Figure 3:
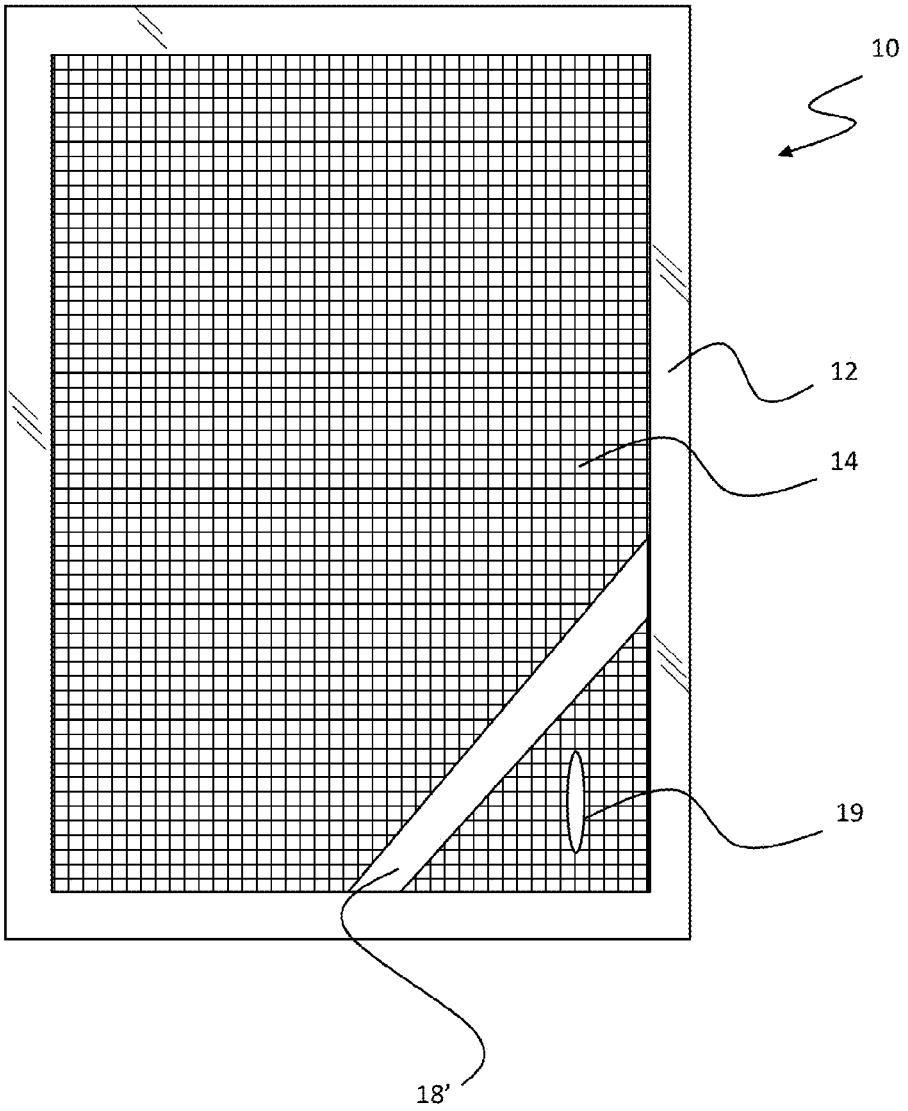
FIG. 3 is a rear view of the screen of FIG. 1.

FIG. 3 is a rear view of the screen of FIG. 1. As shown in FIGS. 2 and 3, in the open position, an electrical cord, wiring, hose or other pipe, cord or conduit may be passed through the screen 14. When the cord or conduit is removed, the screenlet flap 16 is returned to the closed position depicted in FIG. 1 and the aperture is secured against mosquitoes, flies, ants, insects, and other pests.

As noted above, in the embodiment of FIG. 1, the screenlet is secured to the screen 14 via the screenlet frame 18, 18'.

Figure 4:
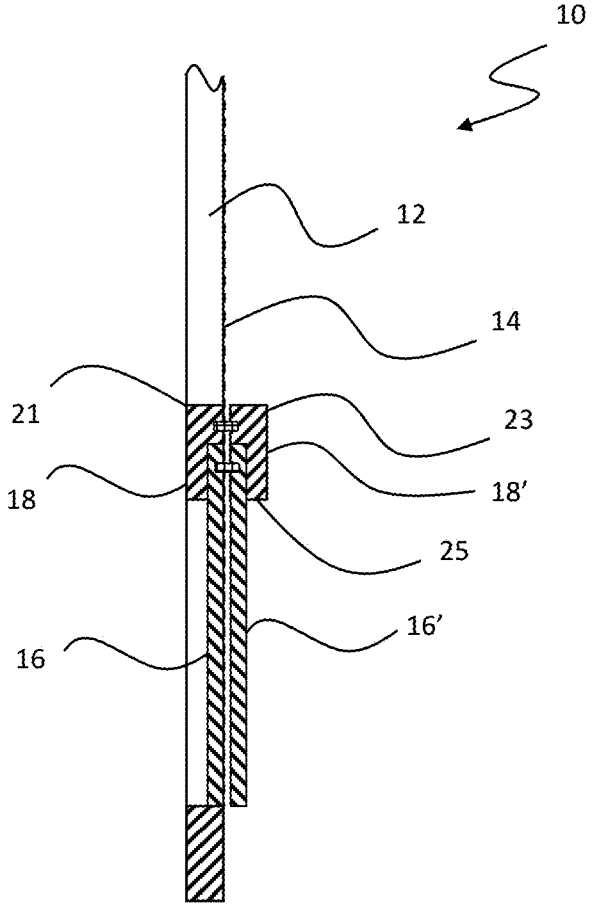
FIG. 4 is a sectional side view of the screen depicted in FIG. 1 taken along the line A-A thereof.

FIG. 4 is a sectional side view of the screen depicted in FIG. 1 taken along the line A-A thereof. The embodiment of FIG. 4 shows an optional second flap 16' mounted on the opposite side of the screen 14 relative to the first flap 16. As shown in FIG. 4, the front and rear screenlet frame segments 18 and 18' are designed to be of interlocking construction by which male members 21 on one segment engage and snap into mating female recesses 23 on the other. In addition, one or more male members 25 in the front or rear segment of the screenlet frame 18, 18' extend into or through the flap 16 before engaging a mating female recess (not shown) in the mating segment of the screenlet frame. The two frame elements may be secured to the screen and flap via screws, pins, magnets, hook, living hinge and loop type fasteners, adhesive, hook and loop type fasteners or other suitable connectors.

Figure 5:
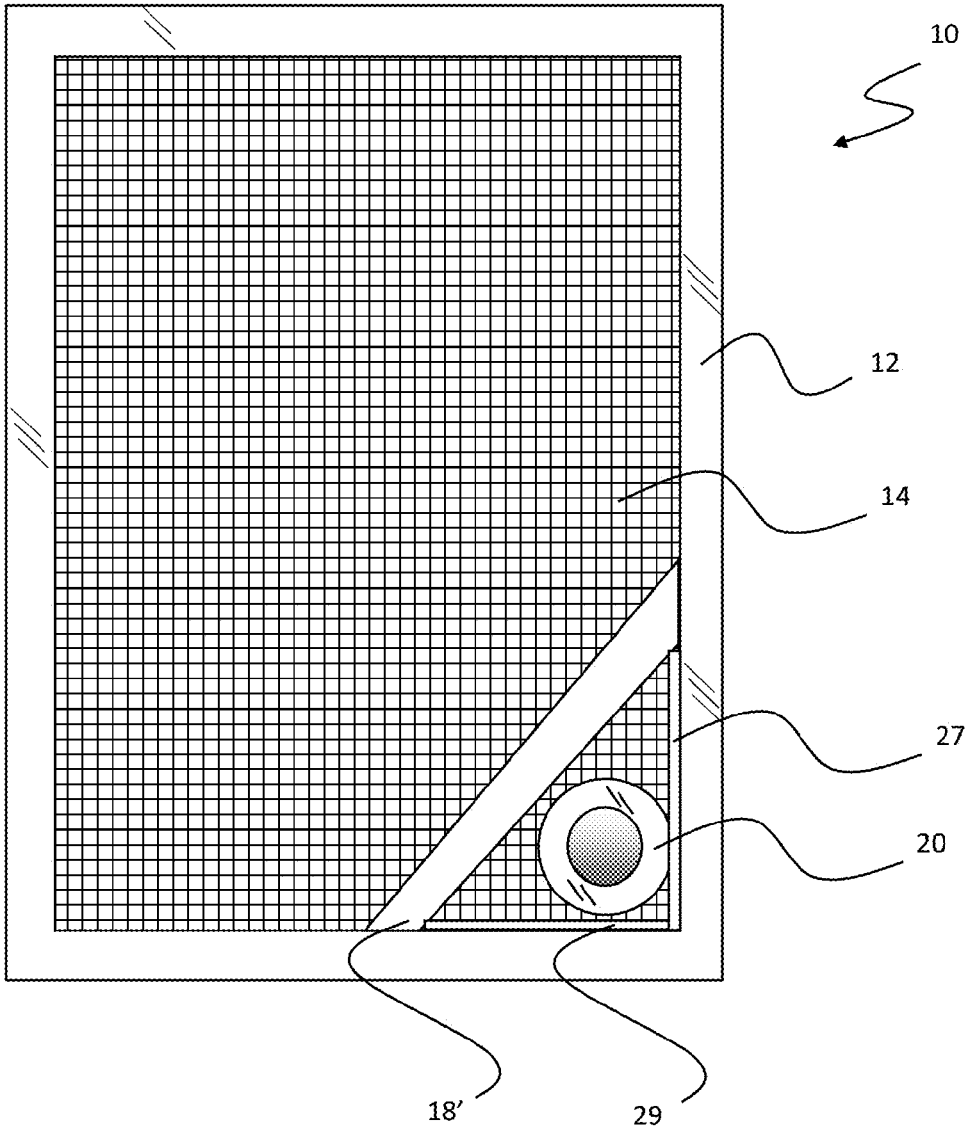
FIG. 5 is a rear view of an alternative embodiment of the screen of FIG. 1 with an annular magnet.

In accordance with the present teachings, the flap may be of any design or construction. Indeed, the flap need not be triangular. Further, the flap may be implemented with a thick liquid rubber, plastic or epoxy and solidifies on application. In this case, a section of wax paper or other buffer may be used to ensure that the flap may be lifted after the liquid has solidified to provide the flap. The flap may be made of magnetic material, or fitted with one or more magnets, to engage one or more metal segments mounted in the screen, as depicted in FIG. 5 below, or the screen 14 directly or the frame 16 directly. As another option, the flap may be fitted with a metal section to engage a magnet mounted on the screen or frame.

Further, the screenlet may be implemented without a frame. For example, the flap may be the screen itself. In this case, the screen would be cut away from or otherwise mounted separate from the screen frame for free movement relative to the frame along a corner section thereof. In this case, the open screen corner flap may be secured to the frame via magnets mounted along the edge of the screen flap and/or frame.

FIG. 5 is a rear view of an alternative embodiment of the screen of FIG. 1 with an annular magnet. In this embodiment, the annular ring 20 is made of magnetic material, to retain the flap 16 (not shown) in the closed position. The annular ring 20 includes an opening or aperture therethrough (shown shaded) through which a cord or hose is passed as discussed above. The aperture serves as a cable rest. The cable rest is built into the framing, in order to reduce tension of a loose cable passed through the screenlet and screen or aperture.

In this embodiment, additional support elements 27 and 29 are included on one side of the screen or the other or on both, to support the annular ring 20 in the screen 14. In the best mode, the support elements 27 and 29 provide a male and female triangular like gasket that secures the mesh in the triangular area from the rest of screen mesh and acts as a sealant/door jam to the magnet flaps. In the best mode, the gaskets are provided on the inner most layers. These male and female gaskets secure to the mesh and isolate it from the rest of the window screen. The gaskets not only seal around the mesh, they also provide a magnetic rim to help keep the magnetic flaps in the closed position, when not in use.

Thus, the present invention has been disclosed with respect to an illustrative embodiment. Those having ordinary skill in the art and access to the present teachings will recognize additional modifications, applications and embodiments within the scope thereof. For example, as noted above, the present invention is not limited to the size, shape, construction or placement of the screenlet nor the manner of securing the screenlet to the screen. In addition, the screenlet is not limited to use with a screen. The present teachings may be used with a window as well.

One of ordinary skill in the art will appreciate other applications for the screenlet without departing from the scope of the present teachings.

It is therefore intended by the appended claims to cover any and all such applications, modifications and embodiments within the scope of the present invention.

Accordingly,

What is claimed is:

1. A screen comprising:

a rectangular screen frame having top, bottom and side edges;

a screen secured within the frame, said screen having an aperture therethrough; and a screenlet including:

a triangular flap; and a screenlet frame mounted diagonally at a corner of said screen frame between a bottom and a side edge thereof for securing the flap to the screen over said aperture and a portion of said screen surrounding said aperture, whereby said flap is secured to said screen along one edge thereof to hold said flap in place along said edge while said flap is lifted in a first angular direction to enable a hose or cored to pass through said aperture and said frame and said portion of said screen being effective to inhibit movement of said flap in a second angular direction past a plane of said screen.

2. The screen of claim 1 wherein the means for securing the flap to the frame includes a magnet.

3. The screen of claim 1 wherein the flap is magnetic.

4. The screen of claim 1 wherein the flap is a flexible material.

5. The screen of claim 4 wherein the flap is rubber.

6. The screen of claim 1 wherein the flap is concentric with the frame and disposed therein such that outer edges of the flap are contiguous with inner edges of the frame.

7. The screen of claim 1 wherein the frame further includes a cable rest.

8. The screen of claim 7 wherein the cable rest is a magnet.

9. The screen of claim 7 further including a magnetic triangular frame housing a gasket.

10. The screen of claim 7 wherein the cable rest is a metallic ring and the flap includes a magnet or magnetic material.

11. The of screen of claim 1 wherein the flap is concentric with the frame and disposed therein such that at least one outer edges of the flap is contiguous with an inner edge of the screen frame.

12. A screen comprising:

a rectangular screen frame having a base and top, bottom and side edges;

a screen secured within the frame, said screen having an aperture therethrough disposed within one foot of the base of the screen near a corner thereof;

a screenlet including:

a triangular flap; and a screenlet frame mounted diagonally at a corner of said screen frame, on both sides of said screen frame, between a bottom and a side edge thereof for securing the flap to the screen over said aperture and a portion of said screen surrounding said aperture, whereby said flap is secured to said screen along one edge thereof to hold said flap in place along side edge while said flap is lifted in a first angular direction to enable a hose or cord to pass through said aperture and said frame and said portion of said screen being effective to inhibit movement of said flap in a second angular direction past a plane of said screen and at least one magnet for selectively securing said aperture whereby a hose or cord may be passed through said aperture when opened and said aperture when closed by force of said magnet prevents insects from passing through said screen.

* * * * *